United States Patent [19]

Stute et al.

[11] 4,030,539

[45] June 21, 1977

[54] CROSS-CURRENT PIPE HEAT-EXCHANGER FOR GASES

[75] Inventors: Manfred Stute, Esslingen; Eggert Tank, Fellbach, both of Germany

[73] Assignee: Daimler-Benz Aktiengesellschaft, Germany

[22] Filed: Aug. 28, 1974

[21] Appl. No.: 501,365

[30] Foreign Application Priority Data

Aug. 28, 1973 Germany ..... 2343310

[52] U.S. Cl. ..... 165/134; 60/39.51 R; 122/DIG. 13; 165/163; 165/176

[51] Int. Cl.[2] ..... F28F 9/04; F28D 7/06

[58] Field of Search ..... 122/DIG. 13; 165/134, 165/146, 142, 163, 176; 60/39.51 R

[56] References Cited

UNITED STATES PATENTS

| | | | |
|---|---|---|---|
| 1,647,570 | 11/1927 | Kling | 122/DIG. 13 |
| 1,786,337 | 12/1930 | Dargent | 165/134 |
| 1,821,765 | 9/1931 | Newman | 165/146 X |
| 2,232,935 | 2/1941 | Bailey | 165/146 X |
| 2,556,186 | 6/1951 | Hegenbarth | 165/146 X |
| 2,989,952 | 6/1961 | Riehl | 165/146 X |
| 3,078,919 | 2/1963 | Brown, Jr. | 165/142 X |
| 3,190,352 | 6/1965 | Simpelaar | 165/134 |
| 3,267,673 | 8/1966 | Hemsworth et al. | 60/39.51 R |
| 3,545,536 | 12/1970 | Peters et al. | 165/134 |
| 3,746,083 | 7/1973 | Tiefenbacher | 165/159 X |
| 3,809,154 | 5/1974 | Heller et al. | 60/39.51 R |

*Primary Examiner*—C. J. Husar
*Assistant Examiner*—Sheldon Richter
*Attorney, Agent, or Firm*—Craig & Antonelli

[57] ABSTRACT

A cross-current pipe heat-exchanger for gases, especially for a gas turbine installation, with at least one collective space for the heat-absorbing gas and a bundle of pipes adjoining a wall of the collective space and formed of a large number of individual pipes fastened in the wall and conductively connected with the collective space; the gas stream which gives off heat thereby flows transversely through the pipe bundle; a number of pipes in the pipe bundle arranged on the inlet side are constructed relatively thick-walled, at least within the area of their fastening in the wall; preferably these thick-walled pipes have a wall thickness of about 50 to 100% of the wall thickness of the wall portion forming the adjacent collective space.

24 Claims, 5 Drawing Figures

FIG. 1
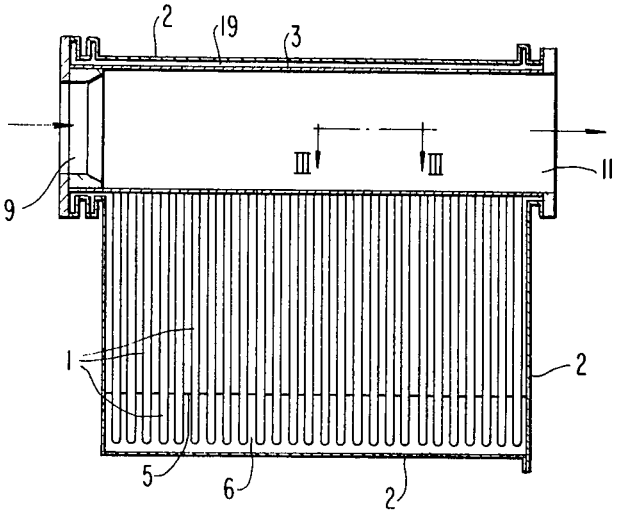
FIG. 2
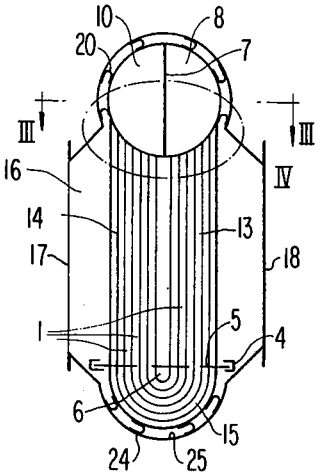
FIG. 3
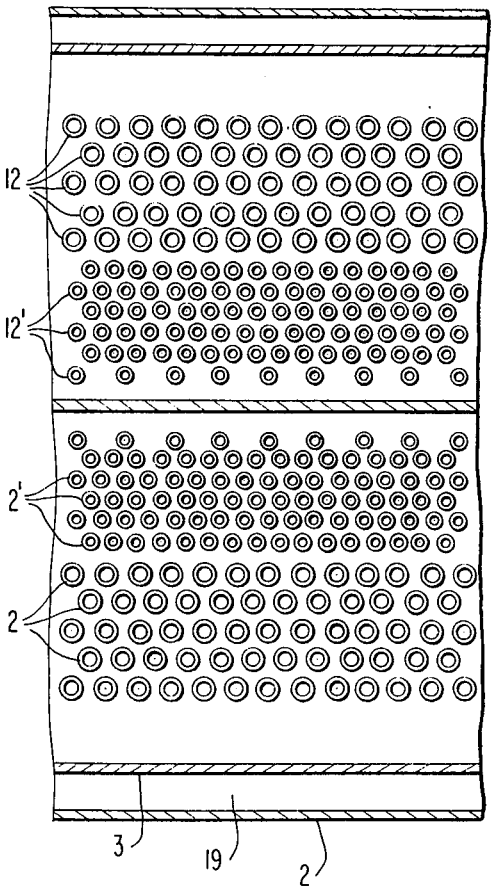
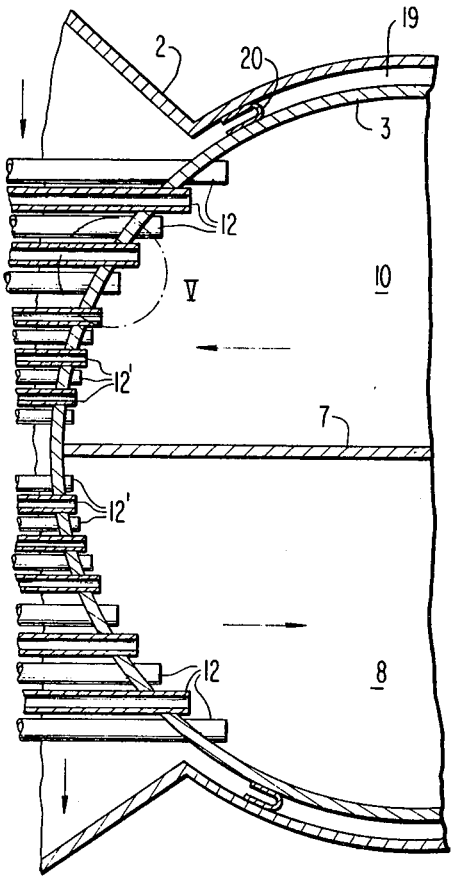
FIG. 4

CROSS-CURRENT PIPE HEAT-EXCHANGER FOR GASES

The present invention relates to a cross-current pipe heat-exchanger for gases, especially for a gas turbine installation, with at least one collective space or common chamber for the heat-absorbing gas and with a pipe bundle adjoining a wall of the collective space and formed of a large number of individual pipes secured in the wall and conductively connected with the collective space or common chamber, whereby the gas stream giving off heat flows transversely through this bundle of pipes.

Heat-exchangers of the aforementioned type, also commonly called recuperators, are used preferably in gas turbine installations for vehicle drives and serve for the preheating of the combustion air (heat-absorbing gas) by the exhaust gas of the gas turbine which gives off heat. However, with gas turbines for vehicle drives, temporarily strongly fluctuating temperature differences occur during the starting and at larger load changes. These temperature fluctuations may be designated as heat shocks, and they lead to a destruction of the heat-exchanger and more particularly of the fastening places of the pipes in the wall of the collecting space or spaces. This shock effect is caused above all by reason of the slight heat storage capacity of the gases present in the pipes. With liquid heat-exchangers, this operation would not be observed by far to the same extent.

It is the aim of the present invention to render the aforementioned heat-exchanger more insensitive against temporarily strongly fluctuating temperatures of the heat-yielding gas stream, i.e., against heat shocks. This is achieved according to the present invention in that the wall thickness of the pipes at least of a large number of pipes arranged on the inflow side in the pipe bundle is constructed as thick-walled as possible, at least within the area of the fastening of the pipes in the wall, preferably approximately of about 50% to 100% of the wall thicknes of the wall of the adjoining collective space or common chamber.

By reason of the larger wall thickness of the pipes exposed to the heat shock, a larger material accumulation is attained at least within the area of the fastening, which, on the one hand, is able to better compensate heat shocks by reason of its higher heat storage capacity conditioned on its mass (smaller temporary temperature gradient) and, on the other, by reason of the better adaptation of the wall thicknesses of the collective space, on the one hand, and of the pipes, on the other, a temperature change of the heat-yielding exhaust gas stream will become effective essentially more uniformly on the temperature of these wall parts so that notwithstanding the continued occurrence of relatively large temporary temperature gradients, the local temperature gradient within the area of the fastening places of the pipes in the wall, transversely to the heat inlet direction, is very small and relative expansions which previously lead to the destruction of the fastening places, are now as good as eliminated, or at least are reduced to a very tolerable extent. The thick-walled pipes, as to the rest, are also more scale-resistant.

With heat-exchangers having a row arrangement of the pipes in the pipe bundle in several rows extending transversely to the inflow direction, advantageously all pipes at least up to the third row, preferably up to the fifth row of the pipe bundle, as counted at each place respectively from the most forwardly disposed pipe, are constructed thick-walled. The large number of the thick-walled pipes extends therefore at least up to into the third row, preferably up to into the fifth row of the pipe bundle. The limitation of the massive pipes to the front pipe rows can be explained in that the heat-emitting gas has already given off its main heat when flowing through these first pipe rows, i.e., the shock effect is therefore limited to the front pipe rows. With the pipes disposed downstream in the pipe bundle, a smaller wall thickness is desirable by reason of the better heat transfer and is also permissive by reason of the fading of the heat shock. By reason of the cooling off of the gases giving off heat which has already taken place, a scale-resistance of the pipes is not as important thereat as with the pipes located on the inflow side.

For manufacturing reasons and for reasons of scale-resistance of the pipes, it is appropriate especially with a heat-exchanger having U-shaped bent pipes in the pipe bundle, whose pipes extend from one collective space or common chamber to another collective space or common chamber, if the thick-walled pipes have a wall thickness that remains constant between the collective spaces. A transition to smaller wall thickness could be realized from a manufacturing point of view only with difficulty without welded or brazed places; and a welded or brazed joint at a pipe would again be endangered by temperature fluctuations as regards its durability.

Accordingly, it is an object of the present invention to provide a cross-current pipe heat-exchanger for gases which avoids by simple means the aforementioned shortcomings and drawbacks encountered in the prior art.

Another object of the present invention resides in a cross-current pipe heat-exchanger for gases which is characterized by a longer length of life and by the absence of failures in the pipe connections of the heat-exchanger.

A further object of the present invention resides in a heat-exchanger of the type described above in which temperature fluctuations in the form of heat-shocks no longer lead to a destruction of the heat-exchanger and in particular of the fastening places of the pipes in the wall of the collecting space or spaces.

A still further object of the present invention resides in a heat-exchanger for gases which is less sensitive to temporarily strongly fluctuating temperatures of the gas stream giving off the heat.

Another object of the present invention resides in a heat-exchanger of the type described above which is able to compensate more readily heat-shocks while keeping small the local temperature gradient within the area of the fastening places of the pipes in the wall and at least far-reachingly reducing relating expansions to a level which is completely acceptable in connection with the heat-exchanger.

Still a further object of the present invention resides in a cross-current heat-exchanger utilizing pipes in which the most endangered pipes are not only more resistant to scaling but also no problems are encountered as regards manufacture notwithstanding a better equalization of the heat-shocks.

These and other objects, features and advantages of the present invention will become more apparent from the following description when taken in .connection with the accompanying drawing which shows, for purposes of illustration only, one embodiment in accordance with the present invention, and wherein:

FIG. 1 is a somewhat schematic side elevational view, partly in cross section of a cross-current pipe heat-exchanger for gases in accordance with the present invention;

FIG. 2 is a somewhat schematic axial cross-sectional view through the cross-current pipe heat-exchanger of FIG. 1;

FIG. 3 is a partial cross-sectional view, on an enlarged scale, taken along line III—III of FIG. 1, and locking radially on the inside of the collective space in the direction of the pipe bundle;

Figure 5:
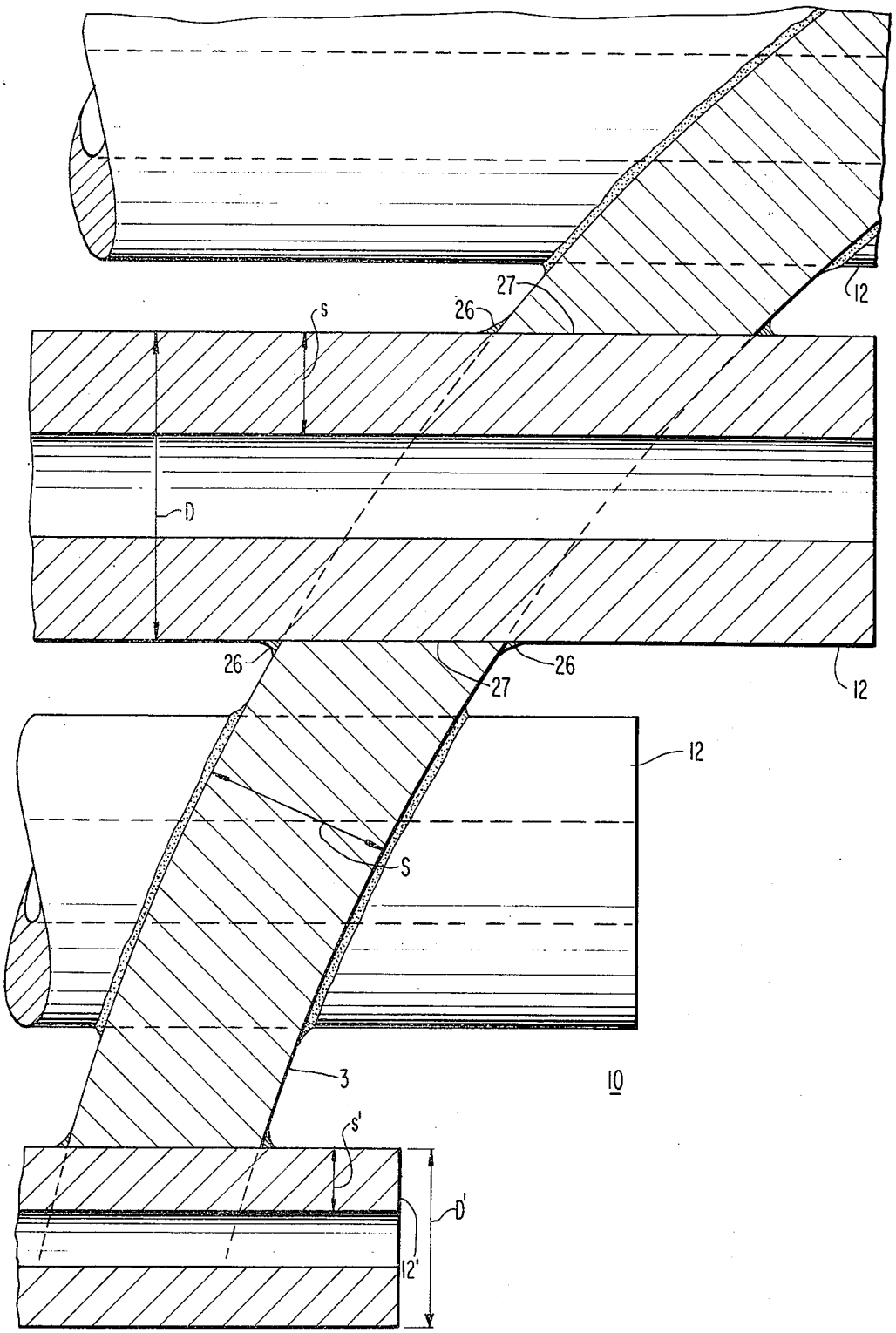

FIG. 4 is a partial cross-sectional view, on an enlarged scale, illustrating the encircled detail indicated in dash and dot line in FIG. 2 and designated therein by reference numeral IV, which illustrates a corresponding lateral view of the illustration of FIG. 3; and FIG. 5 is a partial cross-sectional view, on a greatly enlarged scale, illustrating the encircled detail indicated in dash and dot lines and designated by V in FIG. 4, which illustrates the fastening of the pipes of the pipe bundle in the wall of the collective space.

Referring now to the drawing wherein like reference numerals are used throughout the various views to designate like parts, and more particularly to FIGS. 1 and 2, the schematically illustrated pipe heat-exchanger for a vehicle gas turbine, essentially consists of a pipe bundle 1, through which is conducted the air to be heated up, and of a housing 2 surrounding the same, through which flow the hot gases of the turbine which give off the heat. The housing 2 additionally surrounds a collective container or tank 3 for the heat-absorbing air and together with an apertured plate 5 supported in rails 4 encloses a deflecting space 6, in which the pipe bundle is deflected through 180°. The common container or vessel 3 has a cylindrical configuration and is subdivided by a partition wall 7 into a collective or common inlet space 8 with an inlet opening 9 and into a collective or common discharge space 10 with a discharge opening 11. The pipe bundle 1 is bent U-shaped and consists of a large number of pipes 12 and 12′ of relatively small diameter. The ends of the pipes 12 and 12′ of the one leg 13 of the pipe bundle 1 are connected with the inlet collective space 8 whereas the ends of the other leg 14 of the pipe bundle 1 are connected with the collective discharge space 10. The pipes 12 and 12′ are extended with slight play or clearance through the apertured plate 5 so that they are able to slide within the same. The bent part 15 of the pipe bundle 1 is therefore disposed in the chamber 6 whereas the leg portions 13 and 14 are exposed to the exhaust gases within the space 16 of the housing 2. Reference numeral 17 designates the inlet opening and reference numeral 18 the discharge opening of the housing 12.

The housing 2 surrounds the collective vessel 3 under formation of a gap 19, in which are arranged U-shaped, bent sealing bars or strips 20 permitting thermal expansions. Similar strips or bars 24 are arranged within the curvature area 15 of the pipe bundle 1 between the outwardly disposed pipes 12 and the inner wall 25 of the chamber 6. The entire arrangement and fastening of the individual parts of the heat-exchanger within the housing 2 is made in such a manner that the thermal expansions by reason of a differing heat-up can work out free of any impairment.

As indicated by the arrows, the air to be heated up flows through the inlet aperture 9 into the collective inlet space 8 and from there through the leg portion 13 of the pipe bundle 1. The air thereby absorbs heat from the hot exhaust gases flowing through the space 16 of the housing 2. Upon reversal of the flow direction in the chamber 6, the air absorbs additional heat in the leg portion 14 of the pipe bundle 1 and thereupon leaves the collective discharge space 10 in the heated-up condition.

As already indicated, two different types of pipes 12 and 12′ are used in the U-shaped pipe bundle 1. More particularly, in the leg portion 14 of the pipe bundle 1 disposed on the inflow side, the five front rows of pipes 12, as viewed in the inflow direction, are selected more thick-walled and with a larger diameter (wall thickness $s$ and diameter D) than the pipes 12′ of the pipe bundle 1 disposed downstream (wall thickness $s'$ and diameter D′). As measured and compared to the wall thickness S of the wall 3 of the collective space 10, the wall thickness of the pipes 12 amounts in the illustrated embodiment to about barely 60% of the wall thickness S whereas the thickness of the thinner pipes 12′ amounts only to about barely 30% of the wall thickness S. Since in the reversing section 15 the pipes are continued running parallel adjacent one another for manufacturing reasons, the thick-walled pipes 12 come to lie in the downstream leg portion 13 of the pipe bundle 1 on the outer downstream side within the pipe bundle. For manufacturing reasons, the larger wall thickness of the pipes 12 which remains constant, is maintained also in this portion or section of the pipe bundle, even though it might be dispensed with from a functional point of view.

As FIG. 5 illustrates in great enlargement of the detail V (FIG. 4), the pipes 12 and 12′ are fastened in bores provided in the wall 3 of the collective space 10 by brazing or hard-soldering (hard-solder excess 26, brazed or hard-soldered connection 27). These brazed connections 27 represent certain discontinuity or non-uniformity places as regards the thermal expansion behavior and thermal conductivity behavior, and more particularly independently of the fact whether the pipes are hard-soldered-in, brazed-in, welded-in, pressed-in, mortised-in, or fastened in any other manner. According to the present invention, the parts coming together at this discontinuity or non-uniformity place 27, namely the wall 3 and the pipe 12, are now so constructed at least within the areas of stronger thermal loads of the heat-exchanger, above all within the areas of shock-like thermal loads, that the cross sections which come in contact with each other possess at least approximately a mutually corresponding heat storage capacity and accordingly during the occurrence of thermal shocks a local temperature gradient transverse to the inlet direction of the heat is far-reachingly reduced because the parts 3 and 12 which come together at the places of non-uniformity will heat-up or cool-off far-reachingly uniformly and consequently a relative thermal expansion is avoided within the area of the discontinuity or non-uniformity location. This precaution is necessary, however, only where thermal shocks of considerable extent occur. Further inwardly in the pipe bundle 1 itself, this shock has already faded because by reason of the thermal capacity of the more thick-walled pipes 12 on the inflow side, the gas giving off the heat has already cooled off or warmed-up, depending in which direction the heat-shock took place (heat-shock or cold-shock). Consequently, the pipes disposed further downstream in the pipe bundle may be constructed thin-walled as is favorable for a good and low-inertia heat transfer and as is also desirable for weight savings in vehicles.

The present invention can also be applied to heat-exchanger of different constructions, for example, in connection with such heat-exchangers in which the air inlet and air discharge are disposed on the same side. Similarly, the present invention may also be applied in connection with heat-exchangers having a multiple cross-current and combinations thereof. The collective air vessel or container may have any desired cross-sectional area, for example, may be oval. The pipes connected with the common inlet space and the common outlet space may also terminate directly in the chamber formed by the housing 2 and the apertured plate 5 without the use of arcuate portions. Thus, while we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A heat-exchanger comprising: a plurality of individual heat-exchanger pipes, means for directing the flow of a heat-absorbing gas through said individual heat exchange pipes, means for fixedly connecting each of said individual heat exchange pipes to said flow directing means, at least some of said plurality of individual heat exchange pipes at least at the area of connection with said flow directing means having a wall thickness which is larger than the wall thickness of the remaining individual pipes of said plurality of individual heat exchange pipes.

2. A heat-exchanger according to claim 1, wherein said flow directing means includes a collecting chamber surrounded by an external wall having a predetermined thickness, the wall thickness of each of the thick-walled individual heat exchange pipes being at least equal to the thickness of the external wall.

3. A heat-exchanger according to claim 1, wherein said flow directing means includes a collecting chamber surrounded by an external wall having a predetermined thickness, the wall thickness of each of the thick-walled individual heat-exchange pipes being about 60% of the thickness of the external wall.

4. A heat-exchanger according to claim 3, wherein the heat exchange pipes other than the thick-walled pipes have a wall thickness at least equal to about 30% of the thickness of the external wall.

5. A cross-current pipe heat-exchanger for gases, which includes a collective space means for heating the heat-absorbing gas and a pipe bundle means adjoining a wall of the collective space means, the pipe bundle means being formed of a large number of individual pipes fastened in said wall and conductively connected with the collective space means, means for directing the flow of a gas stream giving off heat substantially transversely through the pipe bundle means, characterized in that the pipe bundle means includes a large number of individual pipes, and at least a certain number of the individual pipes arranged on the inflow side in the pipe bundle means being constructed more thick-walled than the remaining individual pipes of the bundle means at least within the area of the fastening thereof in said wall.

6. A heat-exchanger according to claim 1, characterized in that the thickness of the more thick-walled pipes amounts to about 50% to about 100% of the wall thickness of said wall of the adjoining collective space means.

7. A heat-exchanger according to claim 5, characterized in that the collective space means is subdivided by at least one partition wall into a collective inlet space means and a collective discharge space means with the pipes of the pipe bundle means each connected between the inlet and discharge space means.

8. A heat-exchanger according to claim 5, with pipes in the pipe bundle means which extend from one collective space means to another collective space means, characterized in that the thick-walled pipes extend with constant wall thickness between the collective space means.

9. A heat-exchanger according to claim 8, characterized in that the individual pipes are bent U-shaped and have a substantially constant wall thickness over their entire length.

10. A heat-exchanger according to claim 5, characterized by an apertured plate means through which extend the pipes at a point remote from their fastening in said wall.

11. A heat-exchanger according to claim 10, characterized in that the means for directing the flow of the gas stream giving off heat includes a housing means, and in that said apertured plate means together with the housing defines a collective space means.

12. A heat-exchanger according to claim 11, characterized in that said pipes of the pipe bundle means terminate directly in said last-mentioned collective space means delimited in part by said apertured plate means.

13. A heat-exchanger according to claim 11, characterized in that said pipes extend U-shaped through said last-mentioned collective space means.

14. A heat-exchanger according to claim 1, characterized in that at least a relatively large number of pipes arranged on the inflow side in the pipe bundle means are of thick-walled construction.

15. A heat-exchanger according to claim 14, characterized in that the individual pipes in the pipe bundle means are disposed in several rows which extend transversely to the inflow direction of the gas stream giving off heat, and in that all pipes at least up to the third row are included in the large number of thick-walled pipes, as counted at each place respectively from the most forwardly disposed pipe.

16. A heat-exchanger according to claim 15, characterized in that all pipes up to the fifth row of the pipe bundle means are included in the large number of thick-walled pipes, as counted at each place respectively from the most forwardly disposed pipe.

17. A heat-exchanger according to claim 15, with pipes in the pipe bundle means which extend from one collective space means to another collective space means, characterized in that the thick-walled pipes extend with constant wall thickness between the collective space means.

18. A heat-exchanger according to claim 17, characterized in that the individual pipes are bent U-shaped and have a substantially constant wall thickness over their entire length.

19. A heat-exchanger according to claim 17, characterized in that the collective space means is subdivided by at least one partition wall into a collective inlet space means and a collective discharge space means with the pipes of the pipe bundle means each connected between the inlet and discharge space means.

20. A heat-exchanger according to claim 17, characterized by an apertured plate means through which extend the pipes at a point remote from their fastening in said wall.

21. A heat-exchanger according to claim 20, characterized in that the means for directing the flow of the gas stream giving off heat includes a housing means, and in that said apertured plate means together with the housing means defines a collective space means.

22. A heat-exchanger according to claim 21, characterized in that said pipes of the pipe bundle means terminate directly in said last-mentioned collective space means delimited in part by said apertured plate means.

23. A heat-exchanger according to claim 21, characterized in that said pipes extend U-shaped through said last-mentioned collective space means.

24. A heat-exchanger according to claim 23, characterized in that the thickness of the more thick-walled pipes amounts to about 50% to about 100% of the wall thickness of said wall of the adjoining collective space means.

* * * * *